US007437187B1

(12) United States Patent
Ye et al.

(10) Patent No.: US 7,437,187 B1
(45) Date of Patent: Oct. 14, 2008

(54) SUPERCONDUCTIVE FILTER WITH CAPACITIVE PATCHES PROVIDING REDUCED CROSS-COUPLING

(75) Inventors: Shen Ye, Cupertino, CA (US); Ji-Fuh Liang, San Diego, CA (US)

(73) Assignee: Conductus, Inc., Sunnyvale, CA (US)

( * ) Notice: Subject to any disclaimer, the term of this patent is extended or adjusted under 35 U.S.C. 154(b) by 0 days.

(21) Appl. No.: 09/699,783

(22) Filed: Oct. 30, 2000

(51) Int. Cl.
*H01P 1/203* (2006.01)
*H01B 12/02* (2006.01)

(52) U.S. Cl. ..... 505/210; 333/99 S; 333/204; 333/185

(58) Field of Classification Search ..... 333/99 S, 333/175, 185, 204, 219; 505/210, 700, 701, 505/866
See application file for complete search history.

(56) References Cited

U.S. PATENT DOCUMENTS

| | | | | |
|---|---|---|---|---|
| 3,656,162 | A | 4/1972 | Mee | |
| 4,881,050 | A | 11/1989 | Swanson, Jr. | 333/185 |
| 5,055,809 | A | 10/1991 | Sagawa et al. | |
| 5,132,282 | A | 7/1992 | Newman et al. | 505/701 X |

(Continued)

FOREIGN PATENT DOCUMENTS

DE 23 17 375 10/1974

(Continued)

OTHER PUBLICATIONS

Aitchison, C.S. et al., "Lumped-circuit elements at microwave frequencies" See Fig. 3B, *IEEE Transactions on Microwave Theory and Techniques,* 19(12):928-937, (Dec. 1971).

(Continued)

*Primary Examiner*—Benny T. Lee
(74) *Attorney, Agent, or Firm*—Merchant & Gould P.C.

(57) ABSTRACT

A resonator of a planar circuit type is provided for receiving a signal from an input end and transmitting a signal to an output end. The resonator includes: (a) a dielectric substrate; (b) a ground plane including a layer of conductive material formed on the bottom surface of the substrate; (c) an inductor formed on the top surface of the substrate and connected to the input and output ends; and (d) a series capacitor connected in parallel to the inductor, wherein the series capacitor includes two patches of conductive material formed on the top surface of the substrate, each patch being connected to one respective end of the resonator. Each patch also forms a shunt capacitor with the ground plane, and the capacitance of the shunt capacitor constitutes the majority of capacitance between the ground plane and the end of the resonator that is connected to the patch. The conductive material may be a superconductor, including oxide superconductors. Filters utilizing multiple resonators of the invention are also described. The integration of the series and shunt capacitors results in a more compact resonator and filter layout, allows broader manufacturing tolerances, and allows for more layout flexibility than is attainable with the technology of the prior art.

39 Claims, 7 Drawing Sheets

U.S. PATENT DOCUMENTS

| | | | | | |
|---|---|---|---|---|---|
| 5,231,078 | A | | 7/1993 | Riebman et al. | 505/700 X |
| 5,604,375 | A | * | 2/1997 | Findikoglu et al. | 505/866 X |
| 5,616,539 | A | | 4/1997 | Hey-Shipton et al. | 505/210 |
| 5,618,777 | A | | 4/1997 | Hey-Shipton et al. | 505/210 |
| 5,965,494 | A | * | 10/1999 | Terashima et al. | 505/700 X |
| 6,026,311 | A | | 2/2000 | Willemsen Cortes et al. | 505/210 |
| 6,094,112 | A | | 7/2000 | Goldberger et al. | |
| 6,130,189 | A | | 10/2000 | Matthaei | 505/210 |
| 6,347,237 | B1 | * | 2/2002 | Eden et al. | 333/185 X |

FOREIGN PATENT DOCUMENTS

| | | | | | |
|---|---|---|---|---|---|
| DE | 4 009 076 | | | 9/1991 | |
| EP | 0 350 256 | A2 | | 1/1990 | |
| EP | 1014443 | A1 | | 6/2000 | |
| FR | 2 577 067 | | | 8/1986 | |
| JP | 57 97 715 | | | 6/1982 | |
| JP | 128501 | | * | 5/1991 | 333/185 |
| WO | WO99/52171 | | | 10/1999 | |

OTHER PUBLICATIONS

Chaloupka, H., "High-Temperature Superconductors—A Material for Miniaturized or High-Performance Microwave Components", *Frequenz,* vol. 44, No. 5, pp. 141-144 (May 1990).

Fathy, A., et al., "Superconducting Narrow Band Pass Filters For Advanced Multiplexers", *IEEE MTTS-S Digest,* pp. 1277-1280 (1993).

Fathy, A., et al., "Critical Design Issues in Implementing a YBCO Superconductor X-Band Narrow Bandpass Filter Operating at 77K", *IEEE MTT-S Digest* pp. 1329-1332 (1991).

Hammond, R.B. et al., "Designing with superconductors", See p. 36, left column, line 29-line 35, *IEEE Spectrum* 30(4):34-39 (Apr. 1993) New York US.

Morgan, D., et al., "Lumped Element Filters for Electronic Warfare Systems", *Microwave Journal*, pp. 127-136 (Feb. 1986).

Nagai, Y. et al., "Properties of superconductive bandpass filters with thermal switches" See p. 830, left column, line 17-line 30, *Applied Physics Letters* 63(6):830-832 (Aug. 9, 1993) New York, US.

Newman, N., et al., "High-Temperature Superconducting Microwave Devices: Fundamental Issues in Materials, Physics and Engineering", *Journal of Superconductivity* 6(3):119-160 (1993).

Patzelt, T. et al., "High-temperature superconductive lumped-element microwave allpass sections" See p. 1579, left column, line 37-line 42; Fig. 1, *Electronics Letters* 29(17):1578-1580, (Aug. 19, 1993) Stevenage GB.

Swanson, D., "Thin-Film Lumped-Element Microwave Filters", *IEEE MTT-S Digest*, pp. 671-674 (1989).

Swanson, Jr., D., et al., "A 10 GHz Thin Film Lumped Element High Temperature Superconductor Filter", *IEEE MTT-S Digest*, pp. 1191-1193 (1992).

Zhang, D. et al, "Narrowband lumped-element microstrip filters using capacitively-loaded inductors", *IEEE MTT-S International Microwave Symposium—Digest* 2(16-20):379-382 (May 1995).

Zhang, D. et al., "Microstrip Filters For Wireless Communications Using High-Temperature Superconducting Thin Films", *Applied Superconductivity* 5(3):483-496, 1995 Copyright © 1996 Elsevier Science Ltd.

U.S. Appl. No. 08/706,974, filed Sep. 3, 1996, which is a FWC of U.S. Appl. No. 08/323,365, filed Oct. 14, 1994, now abandoned.

* cited by examiner

FIG. 5(a)
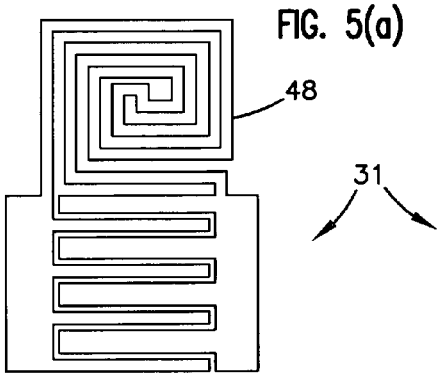
FIG. 5(b)
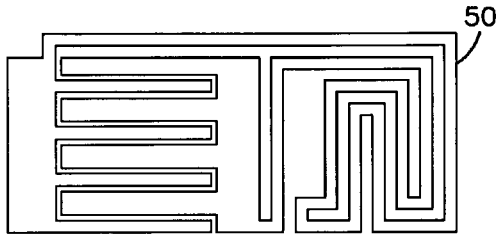
FIG. 5(c)
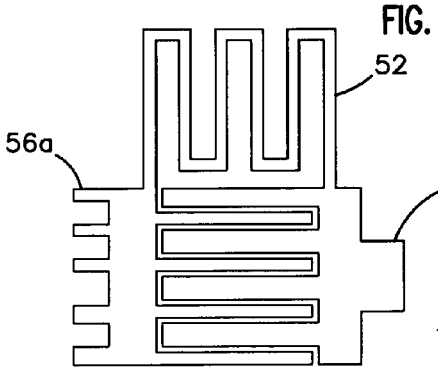
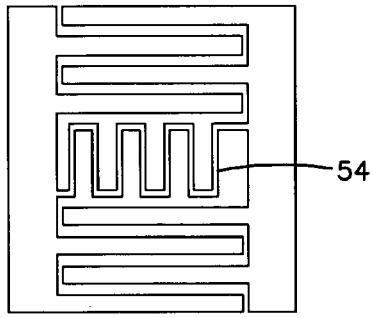
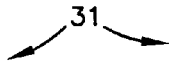
FIG. 5(d)

SUPERCONDUCTIVE FILTER WITH CAPACITIVE PATCHES PROVIDING REDUCED CROSS-COUPLING

BACKGROUND OF THE INVENTION

1. Field of the Invention

The present invention relates generally to planar circuits, more particularly to microstrip filters, and still more particularly to a microstrip resonator having a capacitor-loaded inductor wherein a capacitive element connected in parallel with an inductor is also the primary shunt capacitor of the resonator.

2. Description of the Related Art

Bandpass filters have wide applications in the today's communication systems. The escalating demand for communication channels dictates better use of frequency bandwidth. This demand results in increasingly more stringent requirements for RF filters used in the communication systems. Some applications require very narrow-band filters (as narrow as 0.05% bandwidth) with high signal throughput within the bandwidth. The filter shape must have sharp skirts so that a maximum amount of the available bandwidth may be utilized. Further, there is an increasing demand for small base stations in urban areas where channel density is high. In such applications, very small filter sizes are desirable.

One approach to the problem of obtaining filters with sharp skirts and high throughput has been to make filters using low-loss thin-film high-temperature superconductors (HTS). These filters are usually of microstrip design. The size of individual filter elements in HTS microstrip filters is limited not only by the requirements of the base station, but also by limitations in the available sizes of suitable substrates and deposition equipment.

FIGS. 1(*a*), 1(*b*), and 1(*c*) show a simple, pseudo-lumped element microstrip band pass filter and its equivalent circuit. The filter consists of a planar dielectric substrate 100 (FIG. 1(*b*)), on one side of which is a conductive ground plane 120. The planar circuitry 140 on the opposite side consists of a plurality of resonators, as shown in FIG. 1(*a*). Each resonator consists of two large end patches that approximate shunt capacitors at the resonator ends in the equivalent circuit, and a narrow transmission line in the middle that both approximates the middle resonator inductor and contributes small shunt capacitors at the resonator ends. The amount of coupling between the resonators is controlled by the gap size S, as shown in FIG. 1(*a*), which determines the series capacitance values in the equivalent circuit. For very narrow band filters with bandwidth well below 1%, the required gap size S can be quite large because the requirement of a very small series coupling capacitance. The large end patches also introduce significant stray couplings between non-adjacent parts of the circuit. The effect of stray couplings can significantly distort the filter response, which makes precise control of the couplings quite difficult. In addition, the size of the filter can be undesirably large due to the large gap size required.

Zhang, et al. U.S. patent application Ser. No. 08/706,974, titled "Frequency Transformation Apparatus and Method in Narrow-Band Filter Designs" and Zhang, et al., "Narrowband Lumped-Element Microstrip Filters Using Capacitively-Loaded Inductors", IEEE Transactions on Microwave Theory and Techniques, vol. 43, No. 12, pp. 3030–3036 (1995) disclose using capacitively-loaded inductors to effectively scale down filter bandwidth, see FIG. 2 (example of a band-pass filter) and FIG. 4(*a*) (the equivalent circuit of the device shown in FIG. 2). With a gap size S designed for wider bandwidth, the same filter can achieve a much narrower bandwidth. It is done by replacing inductors in FIGS. 1(*a*), 1(*b*), and 1(*c*) with capacitively loaded inductors. That is, the filter shown in FIG. 2 can use a gap size S that is significantly smaller in than the one for the filter shown in FIG. 1 while achieving the same bandwidth. Thus, much better control of the couplings between the resonators can be obtained. However, because the series capacitor is in parallel with the inductor, many long, very narrow fingers are needed to achieve the required larger serial capacitor and at same time retain smaller shunt capacitors. Such a configuration imposes more stringent requirements on manufacturing tolerances.

The present invention is directed to improving the characteristics of the above-described filters.

SUMMARY OF THE INVENTION

The invention provides filters of planar circuit type such as microstrip and stripline circuits utilizing the resonators that are more compact, allow broader manufacturing tolerances, and allow for more layout flexibility than is attainable with the technology of the prior art.

In accordance with the one aspect of the invention, a resonator of a planar circuit type for receiving a signal from an input end and transmitting a signal to an output end includes: (a) a dielectric substrate having a top surface and a bottom surface; (b) a ground plane including a layer of conductive material formed on the bottom surface; (c) an inductor formed on the top surface and connected to the input and output ends; and (d) a series capacitor connected in parallel to the inductor, wherein the series capacitor includes two patches of conductive material formed on the top surface, each patch being connected to one respective end of the resonator, wherein each patch forms a shunt capacitor with the ground plane, and the capacitance of the shunt capacitor constitutes the majority of capacitance between the ground plane and the end of the resonator that is connected to the patch.

In accordance with another aspect of the invention, a resonator of the planar circuit type for receiving a signal from an input end and transmitting a signal to an output end consists essentially of: (a) a dielectric substrate having a top surface and a bottom surface; (b) a ground plane comprising a layer of conductive material formed on the bottom surface; (c) an inductor formed on the top surface and connected to the input and outpout ends; and (d) two patches of conductive material formed on the top surface, each patch being connected to one respective end of the resonator, wherein each of the two patches of conductive material forms a single capacitor with the ground plane.

In accordance with another aspect of the invention, a resonator of a planar circuit type for receiving a signal from an input end and transmitting a signal to an output end includes: (a) a dielectric substrate having a top surface and a bottom surface; (b) a ground-plane including a layer of conductive material formed on the bottom surface; (c) an inductor formed on the top surface and connected to the input and output ends; and (d) a series capacitor connected in parallel to the inductor, wherein the series capacitor includes two patches of conductive material formed on the top surface, each patch being connected to one respective end of the resonator, wherein each patch forms a single shunt capacitor with the ground plane.

The inductive element and the capacitive elements may be formed from a conductive material such as a superconductor, including oxide superconductors such as YBCO, on a dielectric substrate such as magnesium oxide, sapphire or lanthanum aluminate.

In this configuration, the inductor may be a conductive line formed on the substrate. The line may be formed in a variety of forms to suit the particular design needs. For example, the lines may include a zigzag-shaped segment; it may also include a swirl-shaped segment.

The capacitor connected in parallel to the inductor may be an interdigitized capacitor. Each patch that forms this capacitor also function as a shunt capacitor with the ground plane. Because the both the parallel and shunt capacitors are now integrated, wider fingers in the interdigitized capacitor may be used and the extra shunt capacitor patches in FIG. 2 may be eliminated.

In accordance with the principles of the invention, a microwave filter may be formed by forming multiple resonators on a substrate. The resonators described above may be capacitively or inductively coupled in series. For example, the resonators may be positioned side-by-side in a linear array, so that a pair of input and output ends, one from each pair of adjacent resonators, are positioned in close proximity from each other to form a coupling capacitor.

BRIEF DESCRIPTION OF THE DRAWINGS

Other objects and advantages of the invention will become apparent upon reading the following detailed description and upon reference to the drawings in which:

FIG. 1(*b*) illustrates a cross-section view of the device illustrated in FIG. 1(*a*);

FIG. 1(*c*) illustrates the equivalent circuit of the filter in FIG. 1(*a*);

FIGS. 5(*a*)–(*d*) illustrate examples of alternative embodiments of the invention;

Figure 1A:
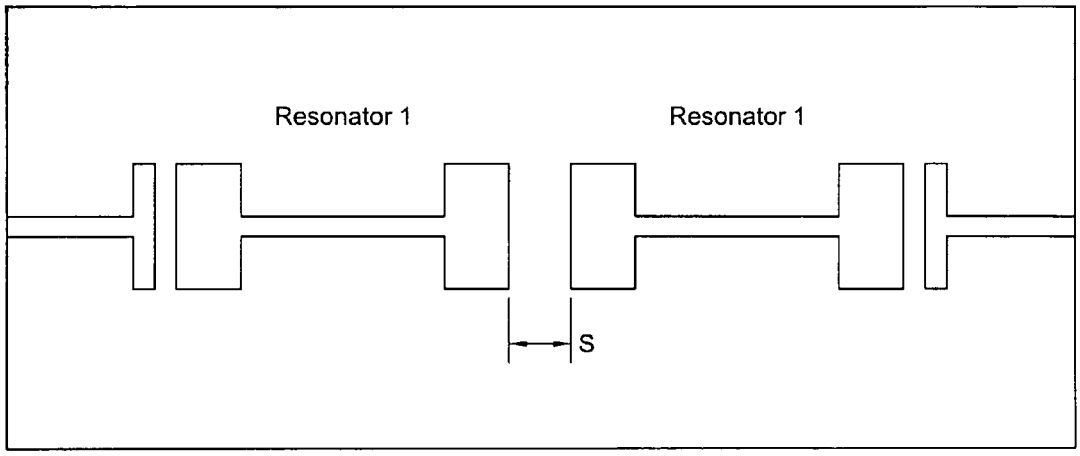
FIG. 1(a) (Prior Art)
FIG. 1(*a*) illustrates the top view of an existing capacitive-coupled band pass microstrip filter.
Figure 1B:
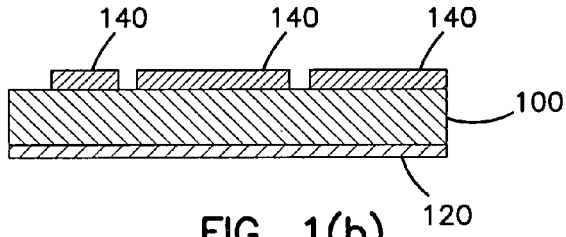
FIG. 1(b) (Prior Art)
Figure 1C:
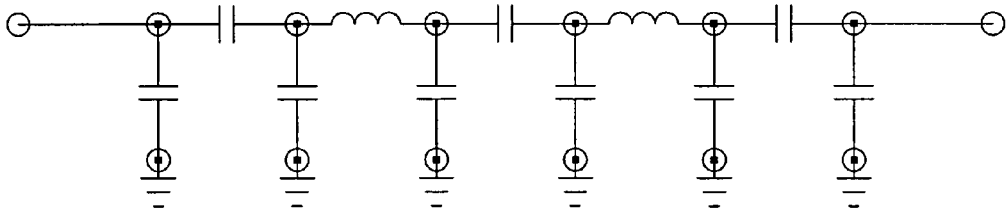
FIG. 1(c) (Prior Art)

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nonetheless be a routine undertaking for those of ordinary skill in the art having the benefit of this disclosure.

Figure 3:
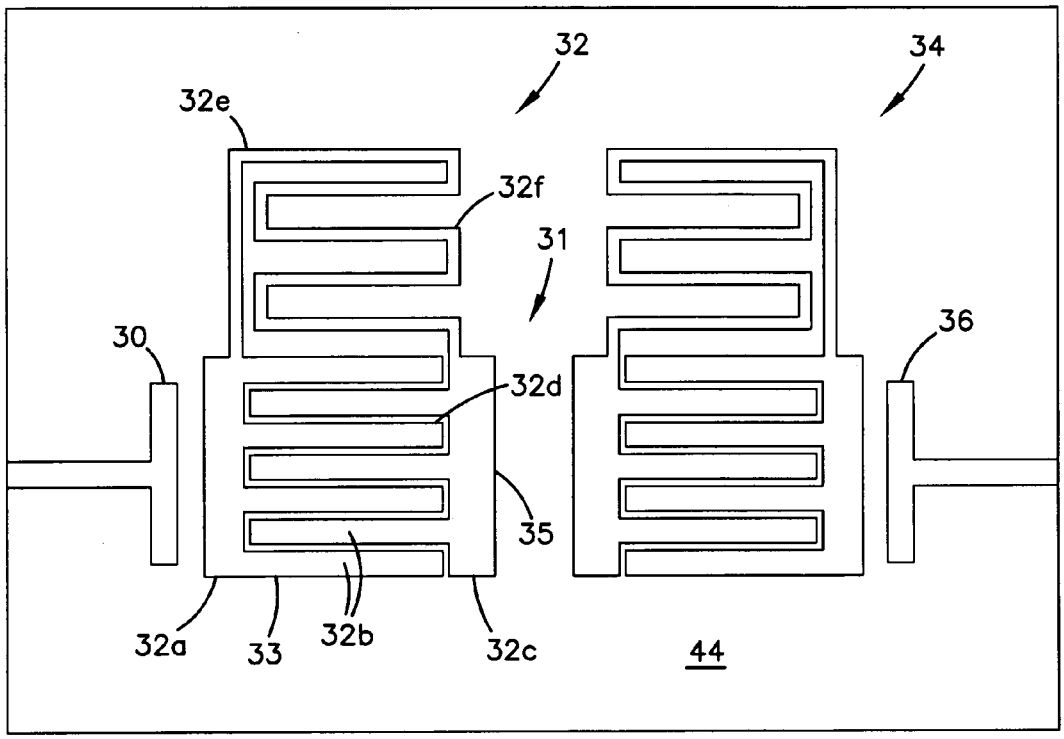
FIG. 3 illustrates a filter including resonators constructed according to principles of the invention.

Referring to FIG. 3, which shows a microstrip filter according to one aspect of the invention, resonators 32 and 34 are placed side-by-side and between the input and output coupling structures 30 and 36. The four structures 30, 32, 34 and 36 are made of conductive materials formed on a dielectric substrate 44. Suitable conductive materials include metals and superconductors such as copper, gold niobium or niobium-tin, and oxide superconductors, such as $YBa_2Cu_3O_{7-d}$ (YBCO), wherein $0 \leqq d \leqq 1$. Methods of deposition of metals and superconductors on substrates and of fabricating devices are well known in the art, and are similar to the methods used in the semiconductor industry. Focusing more closely on one 32 of the resonators, it includes an inductor 32*e* and a capacitor such as an interdigitized capacitor 31, which is formed between two patches of conductors 32*a* and 32*c* at the input and output ends, respectively, of the resonator. The interdigitized capacitor 31, includes a number of the interdigitized fingers 32*b*, which are separated by a gap 32*d*. The capacitor 31 is connected in parallel to an inductor 32*e*, which may take on a variety of forms including a having a zigzag-shaped portion 32*f* (FIG. 3), 52 (FIG. 5(*c*)) and 54 (FIG. 5(*d*)), a swirl-shaped portion 48 (FIG. 5(*a*)), and others (e.g. 50, as shown in FIG. 5(*b*)) to suit the space and inductance requirements. The inductor may also be positioned relative to the interdigitized capacitor in a variety of ways, as shown in FIGS. 5(*a*)–5(*d*), including inside the footprint defined by the interdigitized capacitor 31 (FIG. 5(*d*)).

Referring to FIG. 3, which shows a microstrip filter according to one aspect of the invention, resonators 32 and 34 are placed side-by-side and between the input and output coupling structures 30 and 36. The four structures 30, 32, 34 and 36 are made of conductive materials formed on a dielectric substrate 44. Suitable conductive materials include metals and superconductors such as copper, gold, niobium or niobium-tin, and oxide superconductors, such as $YBa_2Cu_3O_{7-d}$ (YBCO), wherein $O \leqq d \leqq 1$. Methods of deposition of metals and superconductors on substrates and of fabricating devices are well known in the art, and are similar to the methods used in the semiconductor industry. Focusing more closely on one 32 of the resonators, it includes an inductor 32*e* and a capacitor such as an interdigitized capacitor 31, which is formed between two patches of conductors 32*a* and 32*c* at the input and output ends, respectively, of the resonator. The interdigitized capacitor 31, includes a number of the interdigitized fingers 32*b*, which are separated by a gap 32*d*. The capacitor 31 is connected in parallel to an inductor 32*e*, which may take on a variety of forms including a having a zigzag-shaped portion 32*f* (FIG. 3), 52 (FIG. 5(*c*)) and 54 (FIG. 5(*d*)), a swirl-shaped portion 48 (FIG. 5(*a*)), and others (e.g. 50, as shown in FIG. 5(*b*)) to suit the space and inductance requirements. The inductor may also be positioned relative to the interdigitized capacitor in a variety of ways, as shown in FIGS. 5(*a*)–5(*d*), including inside the footprint defined by the interdigitized capacitor 31 (FIG. 5(*d*)).

The patch of conductive material 32*a* (with the fingers 32*b* that are connected to it) also forms an input shunt capacitor 33 with respect to the ground plane (not shown) at back of the substrate 44. The capacitance of the shunt capacitor 33 may be determined by the sizes and shapes of the fingers 32*b*, other portions of the patch 32*a*, and the dielectric constant of the substrate. For example, the shape of the patch 32*a* may be tailored to include irregular patterns 56*a* and 56*b* to accommodate coupling and spatial requirements of the particular apparatus, as shown in FIG. 5(*c*). An output shunt capacitor 35 is similarly formed by the other half of the interdigitized capacitor 31.

Figure 2:
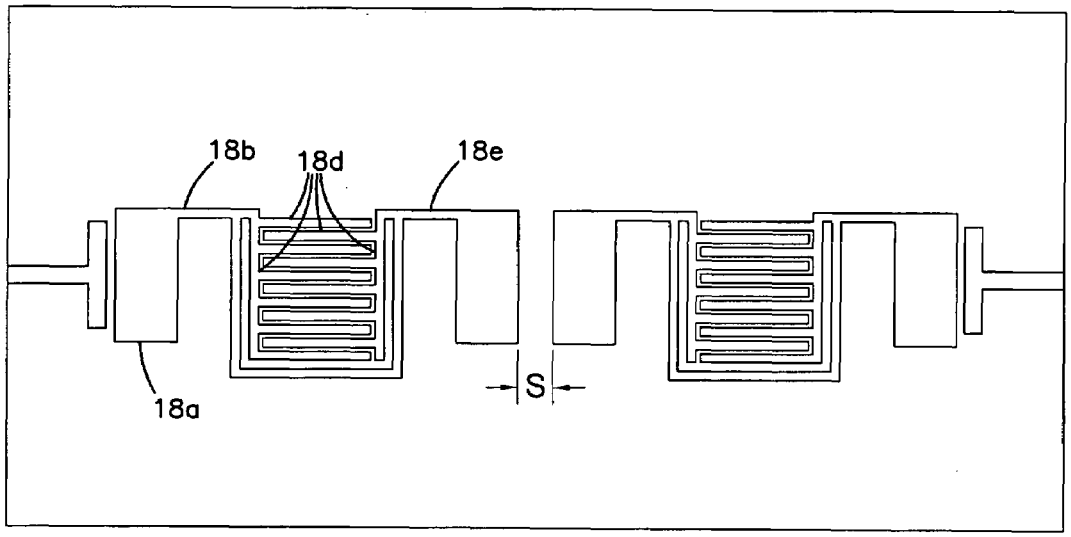
FIG. 2 illustrates a band-pass filter with capacitively loaded inductor.
Figure 4A:
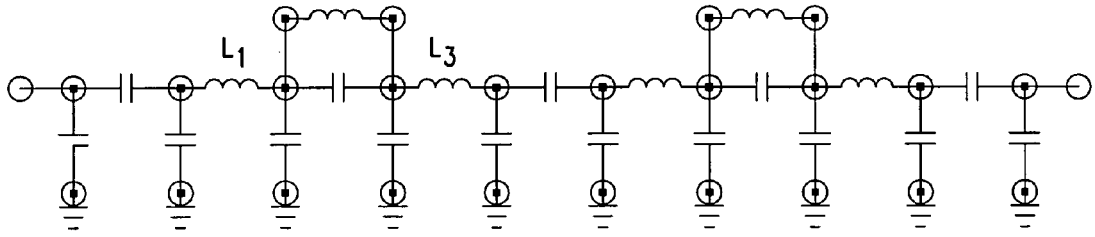
FIGS. 4(*a*) and 4(*b*) illustrate, respectively, the equivalent circuits of the filters shown in FIGS. 2 and 3.
Figure 4B:
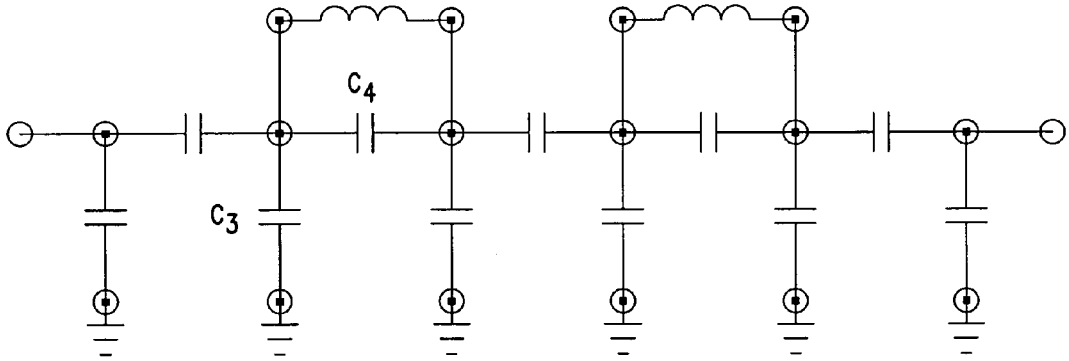

The structure shown in FIG. 3, however, differs from the resonator described in the above-cited references and illustrated in FIG. 2 in very important ways. The series inductors 18*b* and 18*e* in FIG. 2 (L1 and L3 in FIG. 4(*a*)) have been eliminated in the resonator 32. The combination of thin, long fingers 18*d* with a large, separate shunt capacitor 18*a* has been replaced with the integrated patch of conductive material 32*a* with wider fingers 32*b* that functions both as parallel (C4 in FIG. 4(*b*)) and the primary shunt capacitors (C3 in FIG. 4(*c*)). The resonator of the present invention has a more compact footprint than the one shown in FIG. 2, affords more flexibility in length and shape of the various parts of the resonator 32. The wide fingers 32*b* not only contribute the series capacitance necessary for narrow band applications, but also has a wide flexibility to contribute significantly to the end shunt capacitance required by the resonator, depending on the width of the fingers. Wider fingers 32*b* also results in less non-adjacent resonator coupling due to smaller end shunt patches. The structure is also less sensitive to manufacturing tolerances due to larger finger width. The design thus also results in higher Q.

Figure 6:
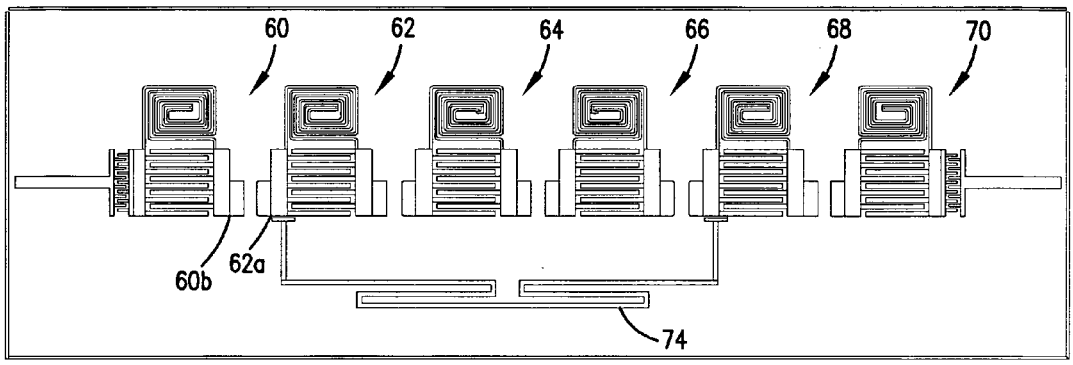
FIG. 6 illustrates a six-pole quasi-elliptic bandpass filter in accordance with one aspect of the invention.
Figure 7:
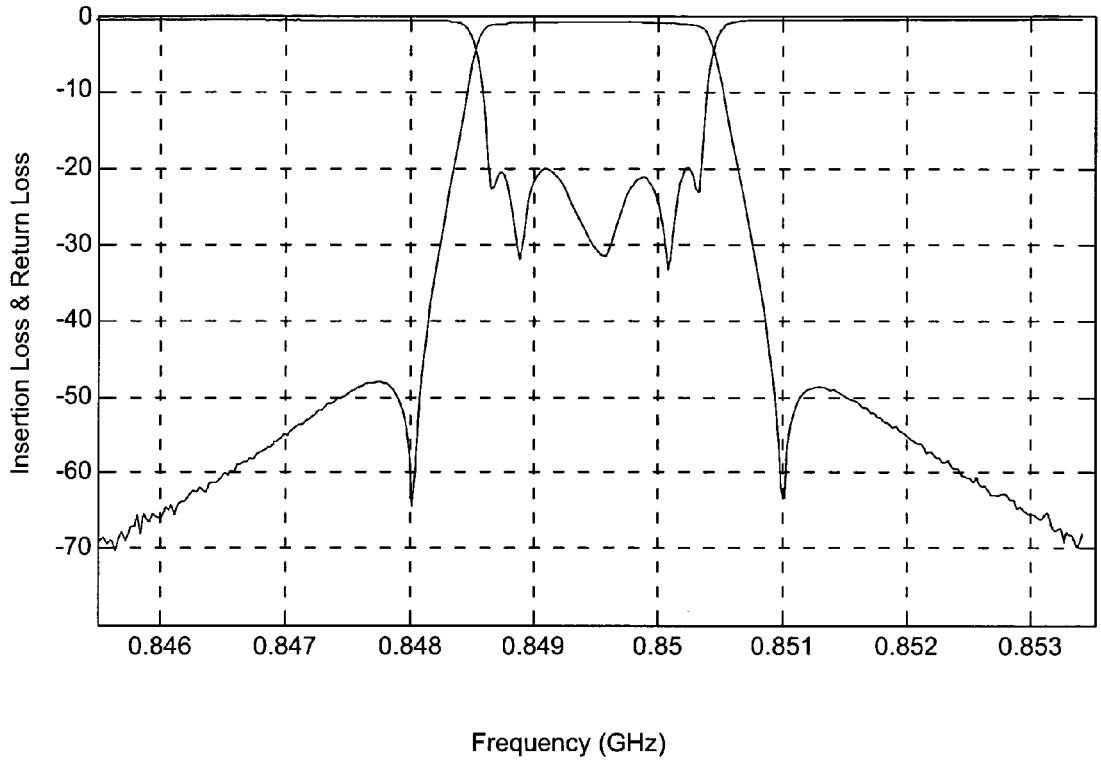
FIG. 7 illustrates the frequency response of the filter shown in FIG. 6.

As another example of the application of the resonator design of the present invention, a six-pole quasi-elliptic band pass filter, as illustrated in FIG. 6, was constructed. Here, six YBCO resonators 60, 62, 64, 66, 68, and 70 were formed side-by-side in series on a 20 mil thick magnesium oxide substrate. The pairs of adjacent input and output patches (e.g. 60*b* and 62*a*) from pairs of adjacent resonators form capacitive couplings in the series. A coupling line 74 between resonators 62 and 68 was designed to generate a transmission zero at each side out of the pass band. The overall size of the filter is about 1.8 in. long and 0.7 in. wide at center frequency 849.5 MHz and 0.18% bandwidth. The size of the fingers of the interdigitized capacitors is about 8 mils wide and 116 mils long making the ratio between the width and length about 1:15. For a greater shunt capacitance, wider fingers may be used. FIG. 7 illustrates the frequency response of the filter shown in FIG. 6. The filter showed minimal non-adjacent resonator interactions and very high unloaded quality factor.

The particular embodiments disclosed above are illustrative only, as the invention may be modified and practiced in different but equivalent manners apparent to those skilled in the art having the benefit of the teachings herein. The principles of the invention apply generally to all planar circuits, including microstrip circuits, stripline circuits, and coplanar waveguides. For example, wherever desirable, the same conductive patches deposited on a substrate may be used to realize both series and shunt capacitors, thereby eliminating the need for separate sets of patches. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

We claim:

1. A filter comprising:

(a) a dielectric substrate having a top surface and a bottom surface;

(b) a ground plane comprising a layer of conductive material provided on the bottom surface; and (c) a plurality of resonators, each resonator being arranged to receive a signal from an input end and transmit a signal to an output end, and each resonator comprising (d) an inductor provided on the top surface and connected to the input and output ends; and (e) a series capacitor connected in parallel to the inductor, wherein the series capacitor comprises two patches of conductive material provided on the top surface, each patch being connected to one respective end of the resonator, wherein each patch forms a shunt capacitor with the ground plane, and the capacitance of the respective shunt capacitor constitutes at least part of capacitance between the ground plane and the end of the resonator that is connected to the corresponding patch, and wherein the series capacitor is sufficiently capacitive, in the absence of a biasing voltage, to reduce cross-coupling between non-adjacent resonators.

2. The filter of claim 1, wherein the capacitance of the shunt capacitor connected to each end of each resonator constitutes substantially the entire capacitance between the end connected to the respective shunt capacitor and the ground plane.

3. The filter of claim 2, wherein each of the two patches of conductive material includes a plurality of elongated portions, the elongated portions from the two patches forming an interdigitized pattern.

4. The filter of claim 3, wherein the conductive material comprises a superconductor.

5. The filter of claim 4, wherein the superconductor comprises an oxide superconductor.

6. The filter of claim 5, wherein the oxide superconductor comprises YBCO.

7. The filter of claim 6, wherein the dielectric substrate is magnesium oxide, sapphire or lanthanum aluminate.

8. A filter comprising the plurality of resonators of claim 5, wherein the plurality of resonators share a common dielectric substrate and are linked in series via one or more capacitive links.

9. A filter comprising the plurality of resonators of claim 5, wherein the plurality of resonators share a common dielectric substrate and are positioned in a linear array, wherein the input end of one resonator is positioned in proximity to the output end of an adjacent resonator.

10. The filter of claim 4 wherein each resonator has a resonance frequency in the microwave frequency range.

11. The filter of claim 4, wherein the inductor in each resonator comprises a conductive line having a zigzag-shaped portion.

12. The filter of claim 4, wherein the inductor in each resonator comprises a conductive line having a swirl-shaped portion.

13. The filter of claim 3, wherein each of the elongated, interdigitized portions has a length and a width, wherein the ratio between the width and length is approximately 1:15 or greater.

14. A filter of claim 1, wherein the series capacitor each of the each series capacitor defines a footprint, and wherein the inductor in each resonator is positioned within the corresponding footprint.

15. A filter comprising the plurality of resonators of claim 1, wherein the plurality of resonators share a common dielectric substrate and are positioned in a linear array, wherein the input end of one resonator is positioned in proximity to the output end of an adjacent resonator.

16. A filter comprising the plurality of resonators of claim 1, wherein the plurality of resonators share a common dielectric substrate and are linked in series via one or more capacitive links.

17. The filter of claim 1 wherein each resonator has a resonance frequency in the microwave frequency range.

18. The filter of claim 1, wherein the inductor in each resonator comprises a conductive line having a zigzag-shaped portion.

19. The filter of claim 1, wherein the inductor in each resonator comprises a conductive line having a swirl-shaped portion.

20. A filter comprising:

(a) a dielectric substrate having a top surface and a bottom surface;

(b) a ground plane comprising a layer of conductive material provided on the bottom surface;

(c) a plurality of resonators, each resonator being arranged to receive a signal from an input end and transmit a signal to an output end, and each resonator comprising (d) an inductor provided on the top surface and connected to the input and output ends; and (e) a series capacitor connected in parallel to the inductor, wherein the series capacitor comprises two patches of conductive material provided on the top surface, each patch being connected to one respective end of the resonator, wherein each patch forms a single shunt capacitor with the ground plane, and wherein the series capacitor is sufficiently capacitive, in the absence of a biasing voltage, to reduce cross-coupling between non-adjacent resonators.

21. A filter comprising the plurality of resonators of claim 20, wherein the plurality of resonators share a common dielectric substrate and are linked in series via one or more capacitive links.

22. The filter of claim 20, wherein the inductor in each resonator comprises a conductive line having a zigzag-shaped portion.

23. The filter of claim 20, wherein the inductor in each resonator comprises a conductive line having a swirl-shaped portion.

24. The filter of claim 20 wherein each resonator has a resonance frequency in the microwave frequency range.

25. A filter of claim 20, wherein each series capacitor defines a footprint, and wherein the inductor in each resonator is positioned within the corresponding footprint.

26. A filter comprising the plurality of resonators of claim 20, wherein the plurality of resonators share a common dielectric substrate and are positioned in a linear array, wherein the input end of one resonator is positioned in proximity to the output end of an adjacent resonator.

27. The filter of claim 20, wherein each of the two patches of conductive material includes a plurality of elongated portions, the elongated portions from the two patches forming an interdigitized pattern.

28. The filter of claim 27, wherein the conductive material comprises a superconductor.

29. The filter of claim 28, wherein the superconductor comprises an oxide superconductor.

30. The filter of claim 29, wherein the oxide superconductor comprises YBCO.

31. The filter of claim 30, wherein the dielectric substrate is magnesium oxide, sapphire or lanthanum aluminate.

32. A filter comprising the plurality of resonators of claim 29, wherein the plurality of resonators share a common dielectric substrate and are linked in series via one or more capacitive links.

33. A filter comprising the plurality of resonators of claim 29, wherein the plurality of resonators share a common dielectric substrate and are positioned in a linear array, wherein the input end of one resonator is positioned in proximity to the output end of an adjacent resonator.

34. The filter of claim 28, wherein each resonator has a resonance frequency in the microwave frequency range.

35. The filter of claim 28, wherein the inductor in each resonator comprises a conductive line having a zigzag-shaped portion.

36. The filter of claim 28, wherein the inductor in each resonator comprises a conductive line having a swirl-shaped portion.

37. The filter of claim 27, wherein each of the elongated, interdigitized portions has a length and a width, wherein the ratio between the width and length is approximately 1:15 or greater.

38. A filter comprising:

(a) a dielectric substrate having a top surface and a bottom surface;

(b) a ground plane comprising a layer of conductive material provided on the bottom surface;

(c) a plurality of resonators, each resonator being arranged to receive a signal from an input end and transmit a signal to an output end, and each resonator comprising (d) an inductor provided on the top surface and connected to the input and output ends; and (e) means for establishing a series capacitance between the input and output ends and a shunt capacitance between each of the input and output ends and the ground plane, wherein the series capacitance is sufficient, in the absence of a biasing voltage, to reduce cross-coupling between non-adjacent resonators.

39. A filter comprising:

(a) a dielectric substrate having a top surface and a bottom surface;

(b) a ground plane comprising a layer of conductive material provided on the bottom surface;

(c) a plurality of resonators, each resonator being arranged to receive a signal from an input end and transmit a signal to an output end, and each resonator comprising (d) means for establishing an inductance between the input and output ends; and (e) means for establishing a series capacitance between the input and output ends and a shunt capacitance between each of the input and output ends and the ground plane, wherein the series capacitance is sufficient, in the absence of a biasing voltage, to reduce cross-coupling between non-adjacent resonators.

* * * * *

UNITED STATES PATENT AND TRADEMARK OFFICE

CERTIFICATE OF CORRECTION

PATENT NO. : 7,437,187 B1
APPLICATION NO. : 09/699783
DATED : October 14, 2008
INVENTOR(S) : Ye et al.

It is certified that error appears in the above-identified patent and that said Letters Patent is hereby corrected as shown below:

Col. 4, line 40: "wherein O<d<1." should read --wherein 0<d<1.--

Col. 5, line 4: Insert the following omitted paragraph:

--The resonator 32, with its inductor 32e connected in parallel to a capacitor 31, is thus a resonator employing a capacitor-loaded inductor. The principle of such resonators has been described in *Zhang*, et al., "Narrowband Lumped-Element Microstrip Filters Using Capacitively-Loaded Inductors", IEEE Transactions on Microwave Theory and Techniques, vol. 43, No. 12, pp. 3030-3036 (1995) and in the commonly-assigned co-pending application S/N 08/706,974, both of which are hereby incorporated by reference as if set forth fully herein. The combination of inductor 32e connected in parallel to a capacitor 31 can be viewed as a capacitor-loaded inductor with an effective inductance that is frequency-dependent and increases with frequency at about the resonance frequency of the resonator. Such frequency dependence results in a narrower bandwidth relative to what is attainable with an ordinary, frequency-independent inductor.--

Col. 6, lines 59-60, claim 14: "wherein the series capacitor each of the each series capacitor defines" should read --wherein each series capacitor defines--

Signed and Sealed this

Seventeenth Day of March, 2009

John Doll

JOHN DOLL
*Acting Director of the United States Patent and Trademark Office*